US006916429B2

(12) United States Patent
Kool et al.

(10) Patent No.: US 6,916,429 B2
(45) Date of Patent: Jul. 12, 2005

(54) PROCESS FOR REMOVING ALUMINOSILICATE MATERIAL FROM A SUBSTRATE, AND RELATED COMPOSITIONS

(75) Inventors: Lawrence Bernard Kool, Clifton Park, NY (US); Stephen Joseph Ferrigno, Cincinnati, OH (US); Robert George Zimmerman, Jr., Morrow, OH (US); Mark Alan Rosenzweig, Hamilton, OH (US); Curtis Alan Johnson, Schenectady, NY (US)

(73) Assignee: General Electric Company, Niskayuna, NY (US)

( * ) Notice: Subject to any disclaimer, the term of this patent is extended or adjusted under 35 U.S.C. 154(b) by 235 days.

(21) Appl. No.: 10/277,279

(22) Filed: Oct. 21, 2002

(65) Prior Publication Data

US 2004/0074873 A1 Apr. 22, 2004

(51) Int. Cl.[7] ..... B44C 1/22; C03C 15/00; C03C 25/68; C23F 1/00; C23F 3/00

(52) U.S. Cl. ..... 216/104; 134/3; 216/99

(58) Field of Search ..... 216/100, 101, 216/102, 103, 104, 108, 109; 134/2, 3, 41

(56) References Cited

U.S. PATENT DOCUMENTS

| | | | | |
|---|---|---|---|---|
| 3,514,407 A | | 5/1970 | Missel | |
| 4,277,289 A | * | 7/1981 | Lectard et al. | 134/3 |
| 4,713,119 A | | 12/1987 | Earhart et al. | |
| 5,464,479 A | | 11/1995 | Kenton et al. | |
| 5,660,885 A | | 8/1997 | Hasz et al. | |
| 6,238,743 B1 | | 5/2001 | Brooks | |
| 6,379,749 B2 | | 4/2002 | Zimmerman et al. | |
| 6,758,914 B2 | | 7/2004 | Kool et al. | |
| 2002/0100493 A1 | | 8/2002 | Kool et al. | |

FOREIGN PATENT DOCUMENTS

| | | |
|---|---|---|
| EP | 1162286 | 12/2001 |
| GB | 2026038 | 1/1980 |

OTHER PUBLICATIONS

European Search Report—EP03 25 6567, Feb. 10, 2004.

US Patent 2,501,349, F. J. Nagel et al., "Insulation for Magnetic Material", Mar. 21, 1950, This US Patent is Related to FR 950328.

Lawrence Bernard Kool et al., "A Method for Removing a Coating From a Substrate, and Related Compositions", U.S. Appl. No. 09/591,531, filed Jun. 9, 2000.

Lawrence Bernard Kool et al., "Method for Processing Acid Treatment Solution, Solution Processed Thereby, and Method for Treating Articles Therewith", U.S. Appl. No. 10/063,178, filed Mar. 28, 2002.

* cited by examiner

*Primary Examiner*—P. Hassanzadeh
*Assistant Examiner*—Roberts Culbert
(74) *Attorney, Agent, or Firm*—Paul J. DiConza; William E. Powell, III

(57) ABSTRACT

A process for removing aluminosilicate-based material (e.g., "CMAS") from a substrate is described. The material is treated with an aqueous composition containing at least one acid having the formula $H_xAF_6$, in which A is Si, Ge, Ti, Zr, Al, and Ga; and x is 1–6. Treatment of the substrate is often carried out by immersion in an aqueous bath. The process is also very effective for removing CMAS-type material from cavities in the substrate, e.g., cooling holes in a gas turbine component. Related compositions are also described.

33 Claims, 2 Drawing Sheets

PROCESS FOR REMOVING ALUMINOSILICATE MATERIAL FROM A SUBSTRATE, AND RELATED COMPOSITIONS

BACKGROUND OF THE INVENTION

This invention generally relates to methods for removing aluminosilicate-type materials from various substrates. In some specific embodiments, the aluminosilicate material is in the form of a deposit that accumulates on turbine engine components. For example, the aluminosilicate material being removed may reside on airfoil surfaces, or within internal cooling passages.

Ceramic coatings are often used to thermally insulate various sections of turbine engine components, such as the combustor. The coatings allow the engine to operate more efficiently at high temperatures. Examples of such coatings are the thermal barrier coatings (TBC's), which are often zirconia-based, and stabilized with a material like yttria Such coatings must have low thermal conductivity, strongly adhere to the component, and remain adherent throughout many heating and cooling cycles.

The TBC's are often held tightly to the substrate with a metallic bond coating. The bond coatings usually belong to one of two classes: diffusion coatings or overlay coatings. State-of-the-art diffusion coatings are generally formed of aluminide-type alloys, such as nickel-aluminide, platinum-aluminide, or nickel-platinum-aluminide. Overlay coatings typically have the composition MCrAlY, where M is Ni, Co, Fe, or some combination thereof.

In view of the high temperature and harsh operating conditions to which they are sometimes exposed, the TBC's sometimes need to be repaired or replaced. As described in U.S. Pat. No. 6,379,749 (Zimmerman, Jr., et al), a variety of circumstances may require removal of the TBC. Examples include damage during engine operation; coating defects; handling damage, and the like.

Some of the state-of-the-art methods for repairing components protected by a TBC result in removal of the entire TBC system, i.e., both the ceramic coating, as well as the underlying bond coat. The two coatings usually must then be re-deposited. Moreover, techniques used to remove the coatings, such as grit-blasting, can be slow and labor-intensive. These techniques can also be difficult to control, and can sometimes damage the substrate surface beneath the bond coat. With repetitive use, these procedures may eventually destroy the component by reducing its wall thickness.

Other potential problems occur when the bond coat is a diffusion coating. For example, a diffusion aluminide-type coating (e.g., platinum-aluminide) includes a diffusion zone that extends into the substrate surface of the component. Damage to this type of bond coat can occur by the fracturing of brittle phases in the diffusion zone or the overlying additive zone. Furthermore, repeated stripping and re-applications of diffusion-aluminide coatings can undesirably alter the thickness of the component.

As a response to these problems, nonabrasive processes have been developed for removing a TBC. For example, an autoclaving process is sometimes used, in which the TBC is subjected to elevated temperatures and pressures, in the presence of a caustic compound. Another process involves the use of a halogen-containing powder or gas, such as ammonium fluoride ($NH_4F$).

A particularly effective process for removing a ceramic coating is described in the above-mentioned U.S. Pat. No. 6,379,749. In that process, the TBC is treated with an aqueous solution which contains an acid fluoride such as ammonium bifluoride ($NH_4HF_2$), along with a corrosion inhibitor. The process efficiently removes TBC material from various surfaces of the component, without damaging the substrate, or any bond coat which may be present. (After removal of the TBC, the bond coat can be quickly rejuvenated by known techniques, to restore its oxidation protection). Moreover, the process is effective for removing the TBC from any cavities in the component, such as the cooling holes usually present in turbine airfoils.

The ammonium bifluoride process has many advantages in removing ceramic coatings from various surfaces. However, the process is sometimes rendered ineffective in the presence of dirt which may reside on the ceramic surfaces. In the case of turbine engines, the dirt is often formed as various engine deposits during high-speed operation. It is sometimes referred to as "CMAS" (calcium-magnesium-aluminosilicate). In addition to impeding the effectiveness of the ammonium bifluoride solution, CMAS (initially in molten form) can infiltrate and damage the TBC on a turbine engine component. Moreover, CMAS, in fine, particulate form, can also become trapped in various cooling passages within the component. The presence of the CMAS in these regions can undesirably reduce cooling efficiency.

It should thus be apparent that processes for efficiently removing aluminosilicate material from various substrates would be welcome in the art. The processes should also be capable of removing the aluminosilicate material from cavities within the substrate, e.g., cooling passageways. Moreover, these new cleaning techniques should not adversely affect the substrate. They should also not adversely affect any protective coating applied thereon, if the coating is meant to be retained. The processes should also be free of any unacceptable amounts of hazardous fumes in the workplace, or any effluent which cannot easily be treated. Furthermore, these treatment processes should be compatible with other treatment techniques being employed, e.g., stripping processes for removing TBC's and/or bond coat materials.

SUMMARY OF THE INVENTION

A primary embodiment of this invention is a method for removing aluminosilicate-based material from a substrate. The method includes the step of contacting the aluminosilicate-based material with an aqueous composition comprising at least one acid having the formula $H_xAF_6$, or precursors to said acid, wherein A is selected from the group consisting of Si, Ge, Ti, Zr, Al, and Ga; and x is 1–6. As described below, the aluminosilicate-based material is often a mixture described as "CMAS". In the present description, the terms are generally used interchangeably. Moreover, in the turbine engine art, CMAS is sometimes referred to as "dirt".

Preferred $H_xAF_6$ compounds for many embodiments of the material are $H_2SiF_6$, $H_2ZrF_6$, or mixtures of these two acids. Sometimes, the acids can be formed in situ within the aqueous composition, as also described below. The $H_xAF_6$ compound material is usually employed at a concentration in the range of about 0.05 M to about 5 M. Treatment of the substrate is often carried out by immersion in an aqueous bath. In some instances, the bath may also contain specified amounts of a second acid which is stronger than the $H_xAF_6$ compound, as described below. The process of this invention is also very effective for removing CMAS-type material from cavities in the substrate, e.g., cooling holes in a gas turbine component.

The treatment solution described herein is very effective for removing CMAS material from ceramic-coated turbine engine parts. In that case, a process to remove and replace the ceramic coating, e.g., the ammonium bifluoride process used to treat a TBC, can consequently be carried out more efficiently. Thus, another embodiment of the invention is directed to a method for removing at least a portion of a dirt-covered ceramic coating from a metallic substrate, comprising the following steps:

(a) treating the substrate with an aqueous composition comprising at least one acid having the formula $H_xAF_6$, and (b) treating the substrate with an acid fluoride salt and a corrosion inhibitor, wherein the amount of acid fluoride salt in the composition is sufficient to attack the ceramic coating, and the amount of corrosion inhibitor in the composition is sufficient to protect the metallic substrate from attack by the acid fluoride salt.

Still another embodiment of this invention relates to an aqueous stripping composition for removing aluminosilicate-based material from a substrate. The composition includes specified amounts of at least one of the $H_xAF_6$, acids. It can also contain at least one relatively strong acid, along with a variety of other additives.

Further details regarding the various features of this invention are found in the remainder of the specification.

DETAILED DESCRIPTION OF THE INVENTION

Figure 1:
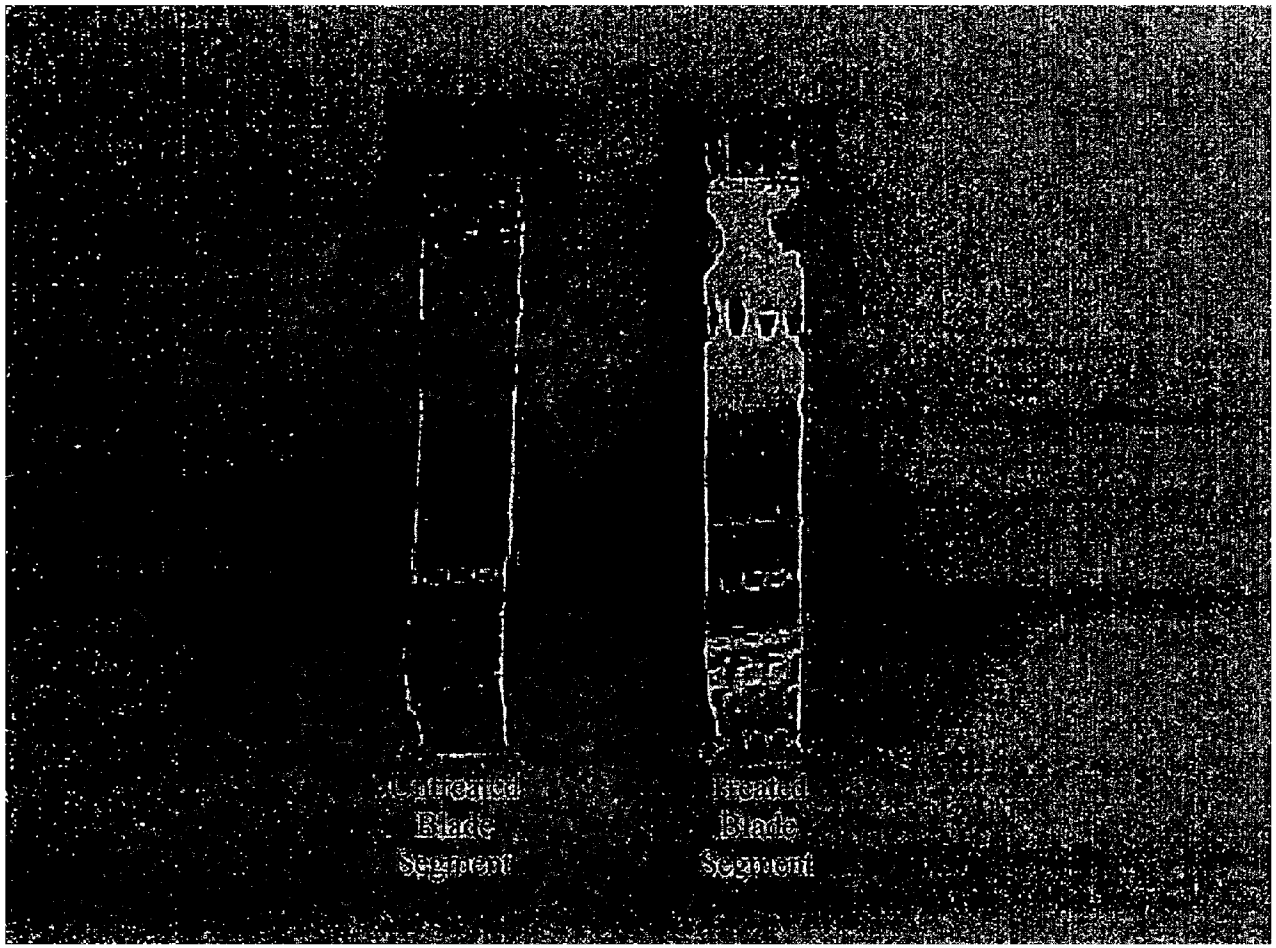
FIG. 1 is a photograph of a turbine engine blade section, before and after treatment according to this invention.

The "dirt" being removed by this invention is primarily a mixture which comprises oxides of calcium, magnesium, aluminum, silicon, and mixtures thereof. As mentioned above, the mixture is often described as "CMAS", as described in U.S. Pat. No. 5,660,885 (Hasz et al), which is incorporated herein by reference. CMAS may contain other elements in minor amounts, e.g., less than about 10% by weight of the total weight of the mixture. Examples of the other elements are nickel, iron, titanium, chromium, barium, and alkali metals. Various compounds of those elements may also be present. The contaminants which contribute to the formation of CMAS can be in a variety of forms, e.g., oxides, phosphates, carbonates, salts, and mixtures thereof.

The specific composition of the aluminosilicate material depends, in large part, on the environment in which the substrate is employed. In the case of a turbine engine component, the aluminosilicate mixture may be formed in part from a variety of environmental contaminants, as described in the Hasz patent. Sources of such contaminants include, but are not limited to, sand, dirt, volcanic ash, fly ash, cement, runway dust, substrate impurities, fuel and air sources, oxidation products from engine components, and the like. One somewhat specific type of CMAS comprises about 5% to about 35% by weight calcium oxide; about 2% to about 35% by weight magnesium oxide; about 5% by weight to about 15% by weight aluminum oxide; and about 5% by weight to about 55% by weight silicon oxide.

The treatment composition for this invention includes an acid having the formula $H_xAF_6$. In this formula, A is selected from the group consisting of Si, Ge, Ti, Zr, Al, and Ga. The subscript x is a quantity from 1 to 6, and more typically, from 1 to 3. Compounds of this type are available commercially, or can be prepared without undue effort. The preferred acids are $H_2SiF_6$ or $H_2ZrF_6$. In some embodiments, $H_2SiF_6$ is especially preferred. The last-mentioned compound is referred to by several names, such as "hydrofluosilicic acid", "fluorosilicic acid", and "hexafluorosilicic acid".

Precursors to the $H_xAF_6$ acid may also be used. As used herein, a "precursor" refers to any compound or group of compounds which can be combined to form the acid or its dianion $AF_6^{-2}$, or which can be transformed into the acid or its dianion under reactive conditions, e.g. the action of heat, agitation, catalysts, and the like. Thus, the acid can be formed in situ in a reaction vessel, for example.

As one illustration, the precursor may be a metal salt, inorganic salt, or an organic salt in which the dianion is ionically bound. Non-limiting examples include salts of Ag, Na, Ni, K, and $NH_4^+$, as well as organic salts, such as a quaternary ammonium salt. Dissociation of the salts in an aqueous solution yields the acid, In the case of $H_2SiF_6$, a convenient salt which can be employed is $Na_2SiF_6$. Moreover, the $H_2SiF_6$ compound can be formed by the reaction of a Si-containing compound (e.g., $SiO_2$) with a fluorine-containing compound (e.g., aqueous hydrogen fluoride).

The preferred level of the $H_xAF_6$ acid which is employed will depend on various factors. They include: the type and amount of aluminosilicate material being removed, its location on or within regions of the substrate; the type of substrate and protective coatings applied thereto; the thermal history of the substrate; the technique by which the substrate is being exposed to the treatment composition (as described below); the time and temperature used for treatment; the maintenance of the treatment composition; the stability of the $H_xAF_6$ acid in solution; and the presence or absence of additional acids, as described below.

In general, the $H_xAF_6$ acid is usually present in the treatment composition at a level in the range of about 0.05 M to about 5 M, where M represents molarity. (Molarity can be readily translated into weight or volume percentages, for ease in preparing the solutions). Usually, the level is in the range of about 0.2 M to about 3.5 M. In the case of $H_2SiF_6$, a preferred concentration range is often in the range of about 0.2 M to about 2.2 M. Adjustment of the amount of $H_xAF_6$ acid, and of other components described below, can readily be made by observing the effect of particular compositions on aluminosilicate removal from the substrate (or from a coating over the substrate).

In some instances, the aqueous composition may contain at least one additional acid, i.e., in addition to the "primary" acid, $H_xAF_6$. It appears that the use of the additional acid (the "secondary" acid or acids) sometimes enhances the removal of the aluminosilicate material, especially from less accessible areas of the substrate that are prone to depletion of the acidic solution. A variety of different acids can be used, and they are usually characterized by a pH of less than about 7 in pure water. The type and amount of additional acid will depend on its ability to remove aluminosilicate material. Another important consideration will be its effect on the substrate, or any coatings deposited thereon (e.g., bond coat and TBC, if they are being retained as part of the coating system). Those skilled in the art understand that care should be taken to avoid any undesirable effects when using a strong. acid, e.g., pitting of the substrate.

In preferred embodiments, the additional acid has a pH of less than about 3.5 in pure water. In some especially preferred embodiments, the additional acid has a pH which is less than the pH (in pure water) of the primary acid, i.e., the $H_xAF_6$ material. Thus, in the case of $H_2SiF_6$, the additional acid is preferably one having a pH of less than about 1.3.

Various types of acids may be used, e.g., a mineral acid or an organic acid. Non-limiting examples include phosphoric acid, nitric acid, sulfuric acid, hydrochloric acid, hydrofluoric acid, hydrobromic acid, hydriodic acid, acetic acid, perchloric acid, phosphorous acid, phosphinic acid, alkyl sulfonic acids (e.g., methanesulfonic acid), and mixtures of any of the foregoing. Those skilled in the art can select the most appropriate additional acid, based on observed effectiveness and other factors, such as availability, compatibility with the primary acid, cost, and environmental considerations. Moreover, a precursor of the acid may be used (e.g., a salt), as described above in reference to the primary acid.

In some preferred embodiments of this invention, the additional acid is selected from the group consisting of phosphoric acid, nitric acid, sulfuric acid, hydrochloric acid, hydrofluoric acid, and mixtures thereof. In some especially preferred embodiments (e.g., when the primary acid is $H_2SiF_6$), the additional acid is phosphoric acid.

The amount of additional acid employed will depend on the identity of the primary acid, and on many of the factors set forth above. Usually, the additional acid is present in the composition at a level in the range of about 0.1 M to about 20 M. In some preferred embodiments (e.g., in the case of phosphoric acid), the preferred range is from about 0.5 M to about 5 M. Furthermore, some especially preferred embodiments contemplate a range of about 2 M to about 4 M. Longer treatment times and/or higher treatment temperatures may compensate for lower levels of the acid, and vice versa. Experiments can be readily carried out to determine the most appropriate level for the additional acid.

The aqueous composition of the present invention may include various other additives which serve a variety of functions. Non-limiting examples of these additives are inhibitors, dispersants, surfactants, chelating agents, wetting agents, deflocculants, stabilizers, anti-settling agents, and anti-foam agents. Those of ordinary skill in the art are familiar with specific types of such additives, and with effective levels for their use. An example of an inhibitor for the composition is a relatively weak acid like acetic acid, mentioned above. Such a material tends to lower the activity of the primary acid in the composition. This is desirable in some instances, e.g., to decrease the potential for pitting of the substrate surface.

Various techniques can be used to treat the substrate with the aqueous composition. For example, the substrate can be continuously sprayed with the composition, using various types of spray guns. A single spray gun could be employed. Alternatively, a line of guns could be used, and the substrate could pass alongside or through the line of guns (or multiple lines of guns). In another alternative embodiment, the coating removal composition could be poured over the substrate (and continuously recirculated).

In preferred embodiments, the substrate is immersed in a bath of the aqueous composition. Immersion in this manner (in any type of vessel) often permits the greatest degree of contact between the aqueous composition and the aluminosilicate material which is being removed. Immersion time and bath temperature will depend on many of the factors described above, such as the specific type of aluminosilicate material present, and the acid (or acids) being used in the bath. Usually, the bath is maintained at a temperature in the range of about room temperature to about 100° C., while the substrate is immersed therein. In preferred embodiments, the temperature is maintained in the range of about 45° C. to about 90° C. The immersion time may vary considerably, but is usually in the range of about 10 minutes to about 72 hours, and preferably, from about 1 hour to about 20 hours. Longer immersion times may compensate for lower bath temperatures. After removal from the bath (or after treatment by any other technique mentioned herein), the substrate is typically rinsed in water, which also may contain other conventional additives, such as a wetting agent.

In some instances, additional cleaning efficiency is obtained by agitating the aqueous composition during treatment of the substrate. Many different ways of providing agitation are available in the art, especially when the component being treated is immersed in a bath. Non-limiting examples include the use of stirrers, shaking equipment, or ultrasonic devices. For example, an ultrasonic device can be employed to provide vibrational energy to the aqueous composition. (Alternatively, agitation devices can be used to shake the substrate itself.). Ultrasonic processes, as well as other agitation techniques, are well-known in the art. As a non-limiting example, some of them are described in U.S. Pat. No. 6,379,749 (Zimmerman, Jr. et al) and U.S. Pat. No. 6,210,488 (R. Bruce), as well as in patent application Ser. No. 09/1460,492 (RD-26,396), filed on Dec. 14, 1999. These documents are incorporated herein by reference. Agitation of the composition is especially useful when the aluminosilicate material being removed is located in cavities within the substrate, e.g., within cooling holes.

The aluminosilicate material being removed according to this invention may be present on a variety of substrates. Usually, the substrate is a metallic material. As used herein, "metallic" refers to substrates which are primarily formed of metal or metal alloys, but which may also include some non-metallic components. Non-limiting examples of metallic materials are those which comprise at least one element selected from the group consisting of iron, cobalt, nickel, aluminum, chromium, titanium, magnesium, zirconium, niobium, and mixtures which include any of the foregoing (e.g., stainless steel).

Very often—especially in the case of turbine engine components—the metallic material is a superalloy. Such materials are known for high-temperature performance, in terms of tensile strength, creep resistance, oxidation resistance, and corrosion resistance. The superalloy is typically nickel-, cobalt-, or iron-based, although nickel- and cobalt-based alloys are favored for high-performance applications. The base element is the single greatest element in the superalloy, by weight.

Illustrative nickel-base superalloys include at least about 40% Ni, and at least one component from the group consisting of cobalt, chromium, aluminum, tungsten, molybdenum, titanium, and iron. Examples of nickel-base superalloys are designated by the trade names Inconel®, Nimonic®, Rene®, (e.g., Rene80®, Rene 95®, Rene142®, and Rene N5® alloys), and Udirnet®, and include directionally solidified and single crystal superalloys. Illustrative cobalt-based superalloys include at least about 30 wt % Co, and at least one component from the group consisting of nickel, chromium, aluminum, tungsten, molybdenum, titanium, and iron. Examples of cobalt-base superalloys are designated by the trade names Haynes®, Nozzaloy®, Stellite® and Ultimet®.

As alluded to previously, removal of CMAS material can be critical in processes for removing underlying ceramic coatings, e.g., TBC's which are being repaired or replaced.

Thus, another aspect of this invention is directed to a method for removing at least a portion of a dirt-covered (primarily CMAS-type dirt) ceramic coating from a metallic substrate. The substrate is first treated with an acid having the formula $H_xAF_6$, as described previously, to remove the CMAS material.

The underlying ceramic coating, often a zirconia-containing TBC, can then be treated with a composition which comprises an acid fluoride salt and a corrosion inhibitor. Examples of the acid fluoride salt are ammonium bifluoride and sodium bifluoride. Examples of the corrosion inhibitors are compositions which comprise sulfuric acid and 1,3-diethylthiourea. Some of the corrosion inhibitors further comprise one or more alkyl pyridines, such as methylpyridine and ethylpyridine. The acid fluoride salt is present in an amount sufficient to attack the ceramic coating. The corrosion inhibitor is usually present in an amount sufficient to protect the metallic substrate from attack by the acid fluoride salt. Other details regarding this type of acid fluoride treatment are provided in the above-referenced U.S. Pat. No. 6,379,749. For example, the referenced patent describes treatment temperatures; the use of ultrasonic energy to enhance removal of the TBC; and the like. Moreover, the patent describes different types of bond coats and stabilized-zirconia coatings, and various deposition techniques.

This embodiment is useful for removing ceramic TBC material which lies over a bond coat, without adversely affecting the bond coat to any substantial degree. The underlying substrate, such as a superalloy turbine component, is also not adversely affected by the process. Moreover, the process can be used to remove TBC material from other locations in which a bond coat is not present, e.g., tooling, equipment, or maskants.

Another embodiment of the present invention relates to an aqueous stripping composition for removing aluminosilicate-based material from a substrate. As described previously, the composition includes at least one acid having the formula $H_xAF_6$, or precursors to said acid. Examples of such acids are $H_2SiF_6$ and $H_2ZrF_6$. Preferred amounts for the acids have been described previously. The composition may further include one or more of the various additives described above, as well as an additional acid which is stronger than the $H_xAF_6$ compound, e.g., a mineral acid or an organic acid.

The following examples are merely illustrative, and should not be construed to be any sort of limitation on the scope of the claimed invention.

EXAMPLE 1

A treatment solution was prepared by charging a 200 mL Teflon® beaker with 150 mL of 23% (by weight, in water) fluorosilicic acid. A 7 mm-long segment of a turbine engine blade was immersed in the solution. The blade segment was formed from a nickel-based superalloy material. It had previously been coated with a platinum-aluminide diffusion coating, and a yttria-stabilized, zirconia-based TBC. The blade segment was dirty, i.e., it contained a substantial amount of CMAS on its surface. During treatment of the blade segment, the solution was maintained at a temperature of 80° C., and was gently stirred. A substantially identical blade segment, cut from an adjacent section of the engine blade, was left untreated.

After 90 minutes, the treated blade segment was removed from the solution, and rinsed in deionized water. FIG. 1 shows the untreated blade segment (darker color), next to the treated blade segment. The figure demonstrates substantially complete removal of the CMAS material from the treated blade segment, without any significant damage to the underlying TBC coating.

A turbine engine blade from another type of gas turbine was also immersed in a treatment solution identical to that described above. This blade was also formed from a nickel superalloy, and coated in a manner similar to the blade segment described above. After immersion for about 4 hours, this blade was also substantially free of all CMAS material.

EXAMPLE 2

Another treatment solution was prepared by charging a 300 mL Teflon® beaker with 150 mL of 23% (by weight, in water) fluorosilicic acid. A 1.7076 g coupon formed from a nickel-based superalloy was immersed in the treatment solution. The coupon had been cut from a superalloy part that had first been coated with a chromide-based material, and then vapor-phase aluminided. Such a coupon is representative of a typical protective coating for a turbine airfoil. It was employed in this example to verify that the treatment of the present invention did not dissolve or otherwise attack the coating or the substrate.

A pellet of CMAS (1 gram) was prepared, using standard laboratory techniques. The pellet was re-fired at 1000° C., and then added to the beaker of the treatment solution. A dirty (CMAS-type dirt) airfoil section from a turbine engine which had been in service was also added to the beaker. The airfoil was formed of a nickel-based superalloy, and was coated with a conventional protective coating system, e.g., a CoNiCrAlY coating applied over a diffusion-aluminide-type coating.

After 2 hours of mild, magnetic stirring of the solution, maintained at 60° C., the pellet of CMAS had disappeared, demonstrating that the treatment solution was effective for dissolving the material. A second pellet of CMAS was added to the solution, and it also dissolved after 2 hours.

Figure 2:
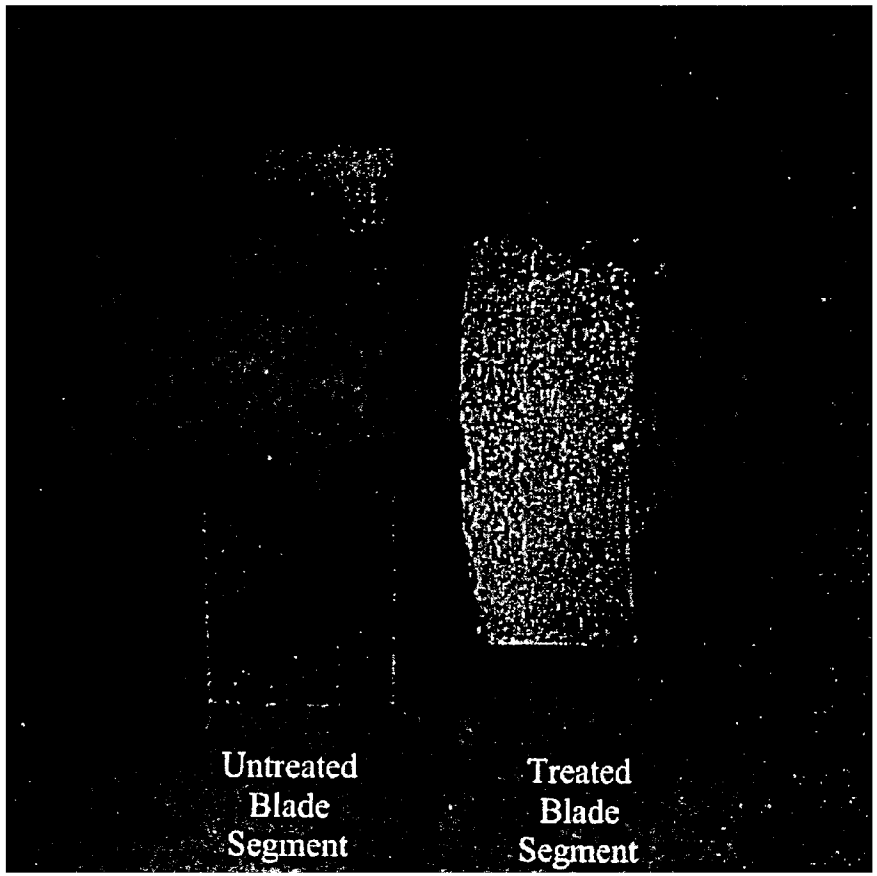
FIG. 2 is another photograph of a turbine engine blade section, before and after treatment according to this invention.

After 4 hours (total) of treatment under these conditions, the airfoil section was clean. FIG. 2 depicts an untreated airfoil section (the longer section in the photograph), and a treated airfoil section (the shorter section in the photograph). Moreover, the coupon weighed 1.7076 g, i.e., it had no weight loss. This demonstrated that the treatment did not result in any loss of coating or substrate.

Having described preferred embodiments of the present invention, alternative embodiments may become apparent to those skilled in the art, without departing from the spirit of this invention. Accordingly, it is understood that the scope of this invention is to be limited only by the appended claims.

What is claimed:

1. A method for removing aluminosilicate-based material from a substrate, comprising the step of contacting the aluminosilicate-based material with an aqueous composition comprising at least one acid having the formula $H_xAF_6$, or precursors to said acid, wherein A is selected from the group consisting of Si Ge, Ti, Zr, Al, and Ga; and x is 1–6, and wherein the substrate comprises a nickel-based or cobalt-based superalloy.

2. The method of claim 1, wherein the aluminosilicate-based material comprises calcium oxide, magnesium oxide, aluminum oxide, and silicon oxide.

3. The method of claim 2, wherein the aluminosilicate-based material comprises about 5% to about 35% by weight calcium oxide; about 2% to about 35% by weight magnesium oxide; about 5% by weight to about 15% by weight aluminum oxide; and about 5% by weight to about 55% by weight silicon oxide.

4. The method of claim 1, wherein x is 1–3.

5. The method of claim 1, wherein the acid is present at a concentration in the range of about 0.05 M to about 5 M.

6. The method of claim 5, wherein the acid is present at a concentration in the range of about 0.5 M to about 3.5 M.

7. The method of claim 1, wherein the precursor of the acid is a salt of the acid.

8. The method of claim 1, wherein the aqueous composition comprises the compound $H_2SiF_6$ or $H_2ZrF_6$.

9. The method of claim 8, wherein the $H_2SiF_6$ compound is formed in situ within the aqueous composition, by the dissociation of a corresponding salt of the compound; or by the reaction of a silicon-containing compound with a fluorine-containing compound.

10. The method of claim 9, wherein the silicon-containing compound is $SiO_2$, and the fluorine-containing compound is HF.

11. The method of claim 1, wherein the aqueous composition is maintained at a temperature not greater than about 100° C.

12. The method of claim 11, wherein the aqueous composition is maintained at a temperature in the range of about 45° C. to about 90° C.

13. The method of claim 1, wherein the composition is stirred or agitated during contact with the aluminosilicate-based material.

14. The method of claim 1, wherein the aqueous composition further comprises at least one additional acid or precursor thereof.

15. The method of claim 14, wherein the additional acid has a pH of less than about 3.5 in pure water.

16. The method of claim 14, wherein the additional acid is present in the composition at a level in the range of about 0.5 M to about 5 M.

17. The method of claim 14, wherein the additional acid is selected from the group consisting of phosphoric acid, nitric acid, sulfuric acid, hydrochloric aid, hydrofluoric acid, hydrobromic acid, hydriodic acid, acetic acid, perchloric acid, phosphorous acid, phosphinic acid, alkyl sulfonic acids, and mixtures of any of the foregoing.

18. The method of claim 1, wherein the aqueous composition further comprises at least one additive selected from the group consisting of inhibitors, dispersants, surfactants, chelating agents, wetting agents, deflocculants, stabilizers, anti-settling agents and anti-foam agents.

19. The method of claim 1, wherein the superalloy comprises at least one element selected from the group consisting of nickel cobalt, iron, aluminum, chromium, titanium, magnesium, zirconium, and niobium.

20. The method of claim 1, wherein the substrate is a component of a turbine engine.

21. The method of claim 20, wherein the component comprises an airfoil.

22. The method of claim 1, wherein a ceramic coating is disposed over the substrate, and the aluminosilicate-based material lies over the ceramic coating.

23. The method of claim 22, wherein a metallic bond coating lies between the substrate and the ceramic coating.

24. The method of claim 23, wherein the ceramic coating is zirconia-based.

25. The method of claim 1, wherein the substrate includes at least one cavity which contains the aluminosilicate-based material and said material is substantially removed after being contacted with the aqueous composition.

26. The method of claim 25, wherein the substrate is a turbine engine component, and the cavity is a cooling hole.

27. A chemical stripping method for removing an aluminosilicate-based material from a superalloy substrate covered by a zirconia-based thermal barrier coating, comprising the step of treating the substrate with an aqueous composition comprising at least one of $H_2SiF_6$ or $H_2ZrF_6$.

28. The method of claim 27, wherein the superalloy substrate is a turbine engine component.

29. The method of claim 27, wherein treatment is carried out by immersing the substrate in a bath of the aqueous composition maintained at a temperature in the range of about 45° C. to about 90° C.; wherein the composition is stirred or agitated while the substrate is immersed therein; and the concentration of the $H_2SiF_6$ or $H_2ZrF_6$ (total) in the bath is in the range of about 0.2 M to about 3.5 M.

30. A method for removing at least a portion of a dirt-covered ceramic coating from a metallic substrate, comprising the following steps:

(a) treating the substrate with an aqueous composition comprising at least one acid having the formula $H_xAF_6$, or precursors to said acid, wherein A is selected from the group consisting of Si, Ge, Ti, Zr, Al, and Ga; and x is 1–6, to remove the dirt; and (b) treating the ceramic coating with a composition comprising an acid fluoride salt and a corrosion inhibitor, wherein the amount of acid fluoride salt in the composition is sufficient to attack the ceramic coating, and the amount of corrosion inhibitor in the composition is sufficient to protect the metallic substrate from attack by the acid fluoride salt.

31. The method of claim 30, wherein the ceramic coating comprises zirconia.

32. The method of claim 30, wherein the acid fluoride salt is ammonium bifluoride, and the corrosion inhibitor comprises sulfuric acid and 1,3-diethylthiourea.

33. The method of claim 30, wherein a bond coating disposed between the metallic substrate and the ceramic coating is not adversely affected by treatment steps (a) or (b).

* * * * *